United States Patent [19]

Oberle

[11] 4,114,652

[45] Sep. 19, 1978

[54] COMBINED STOP AND CONTROL VALVE

[75] Inventor: Arthur Oberle, Ennetbaden, Switzerland

[73] Assignee: BBC Brown Boveri & Company Limited, Baden, Switzerland

[21] Appl. No.: 681,728

[22] Filed: Apr. 29, 1976

[30] Foreign Application Priority Data

Apr. 30, 1975 [CH] Switzerland ..... 5565/75

[51] Int. Cl.[2] ..... F16K 1/00

[52] U.S. Cl. ..... 137/630.14; 137/613; 137/630.15; 251/25

[58] Field of Search ..... 137/613, 630.13, 630.14, 137/630.15; 251/25, 39

[56] References Cited

U.S. PATENT DOCUMENTS

| | | | |
|---|---|---|---|
| 2,426,941 | 9/1947 | Mercier | 251/39 |
| 2,919,101 | 12/1959 | Black | 251/25 |
| 3,729,167 | 4/1973 | Gulich | 251/39 |
| 3,809,126 | 5/1974 | Oberle | 137/630.14 |

*Primary Examiner*—Martin P. Schwadron
*Assistant Examiner*—Richard Gerard
*Attorney, Agent, or Firm*—Burns, Doane, Swecker & Mathis

[57] ABSTRACT

A combined stop and control valve for turbine installations and in particular a steam turbine in which the bodies of independently operable stop and control valve components are arranged co-axially to one another in a common housing. The stop valve body has a bell-shaped configuration terminating in an annular seating surface and includes a servo piston component operating in a cylinder and an associated pilot valve for controlling steam entry into the cylinder from the steam chamber. The control valve body includes a bulb-shaped head connected to one end of a spindle, and the other end of this spindle terminates in a servo piston component operating in a cylinder and an associated pilot valve for controlling steam entry into the cylinder from the steam chamber by way of a longitudinal bore through the spindle and valve head.

1 Claim, 2 Drawing Figures

COMBINED STOP AND CONTROL VALVE

Figure 1:
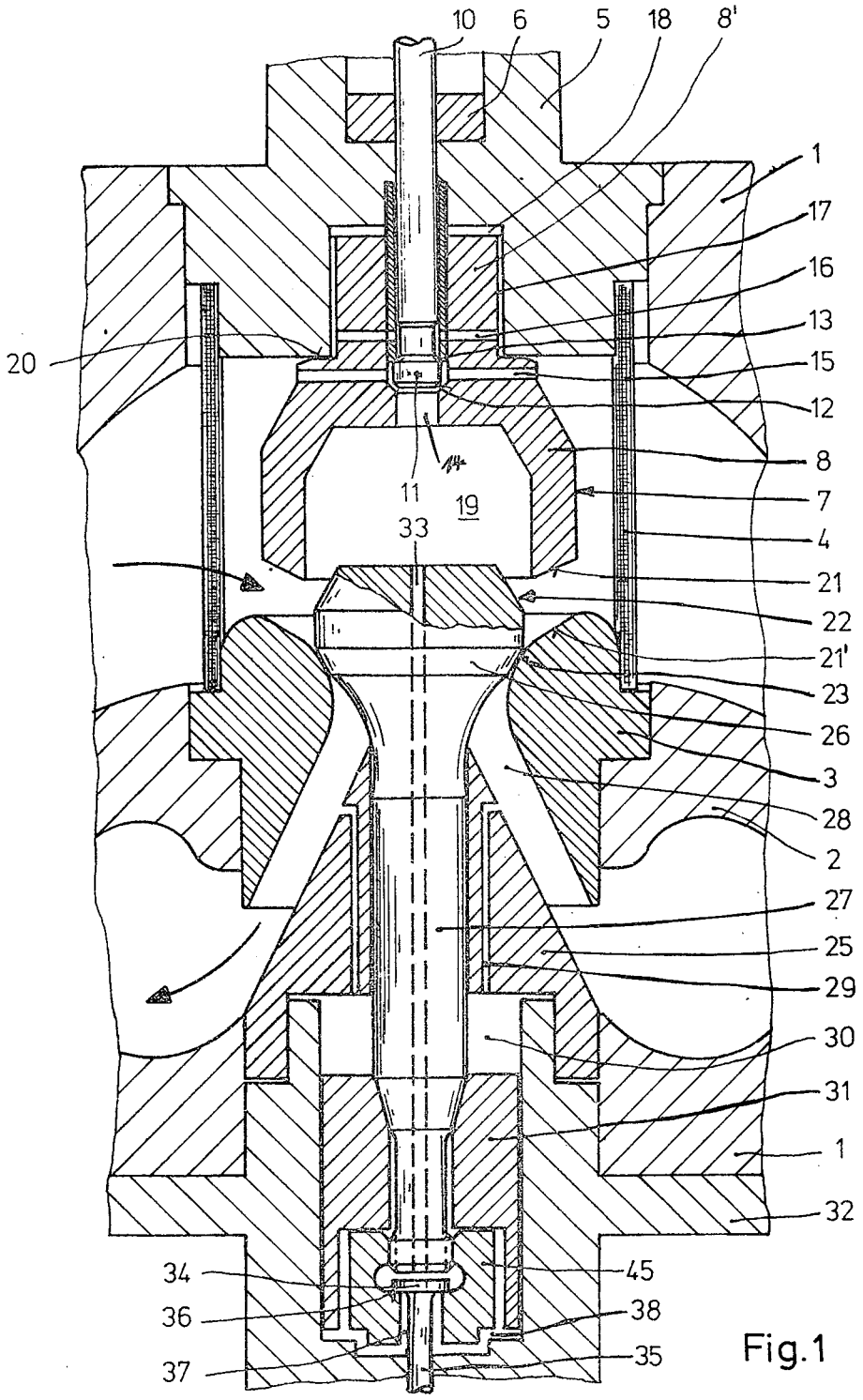

This invention concerns a combined stop and control valve for turbine systems, especially for steam turbine plants, wherein the stop valve body and the control valve body are arranged independently of each other in a common valve housing, the valve bodies being provided with coaxial valve seats located next to each other and immediately at a flow opening. The stop valve body has a bell-shaped configuration into which the control valve body moves, and both valve bodies are provided with pilot valve assemblies.

In the case of modern power plants, and especially so with respect to plants utilizing steam turbines, it is standard practice to install stop valves in advance of the control valves within the pipes carrying the working medium in order to effect an immediate and rapid cut-off in the event of control failures or in response to other external influences. The usual principle of duplicated safety for the whole power installation is thus maintained. For a long time, so-called interceptor valves have been fitted in the reheat line of steam turbines with reheaters, as otherwise the volume of steam present in the volume of steam present in the reheater and in the connecting pipe would be sufficient following a shutdown, even though the high-pressure line was closed, to accelerate the turbine rotor to an unacceptably high overspeed which itself would endanger the whole power installation.

Combined stop and control valve structure are known which are not located in the two separate valve housings but rather are accommodated in a common housing thus making use of the advantageous feature of reduced flow resistance due to the presence of a common valve seat for the stop and control valve components.

In one known construction, tne control valve body has a bell-shaped configuration into which the stop valve body enters during a valve-opening stroke, with the valves arranged such that the valve bodies will be in the same position relative to one another when they are in the end positions.

During the course of power plant development, with large steam volumes it was reasonable to employ this form of valve for live steam control valves, as well as for interceptor valves. The bell-shaped control valve then serves to modify the performance of the steam turbine in response to load variations.

It has been found, however, that this form of valve has a tendency to vibrate when the control valve is in the throttled position. Consequently, damage due to wear and cyclic stresses can occur with prolonged part-load operation.

The principal objective of the invention is to provide an improved construction for the combined stop and control valve which will avoid the above-discussed disadvantages and to re-establish the endangered safety measures.

The invention solves the problems in that the control valve is constructed in the form of a bulb-shaped body which is rigidly connected to a spindle and a piston, with the pilot valve placed at the other end of the spindle and which communicates with the interior space of the stop valve body by way of a central bore within the spindle, the spindle being installed in a lead-through bushing which is provided with passageways leading from the cylinder in which the piston operates to the outlet flow side of the combined valve structure.

In a preferred embodiment of the invention, the pilot valve for the control valve is controlled by a subsidiary spindle and has two valve seats, the latter being arranged within a mounting part that is fixed to the spindle, and wherein this mounting part contains bores and the piston contains one bore in order to connect the upper and lower ends of the cylinder within which the piston operates either by way of the central bore with the interior space of the control valve body, or by way of passageways provided in the valve seat the outlet flow side of the combined valve structure.

The improved combined stop and control valve structure in accordance with the invention is advantageous in that it offers full pressure relief of the control valve by the piston, and also because it provides vibration-free stability of the valve bodies, the stop valve being located in advance of the control valve in relation to the direction of flow of the working medium through the combined valve structure, due to the full pressure differential existing between the live flow medium, e.g., steam, and the atmosphere when in the open position.

A further advantage of the invention results from the bulb-shaped configuration of the control valve body because it allows the most suitable dimensioning of that part of the spindle which is under maximum stress in relation to durability and abrasion. It is further possible to produce the operating spindle (hereinafter referred to as the sub-spindle) at lower costs by using less material because the relief piston as well as the followup piston will operate safely at substantially smaller power, or servo motors respectively.

There is the further advantage that the closing speed of the valve can be influenced by the specific design of the passages in the valve seat.

The clear and distinct construction and the limited number of moving parts leads to geometric simplicity in the design of the steam chamber and a particularly low noise level.

Figure 2:
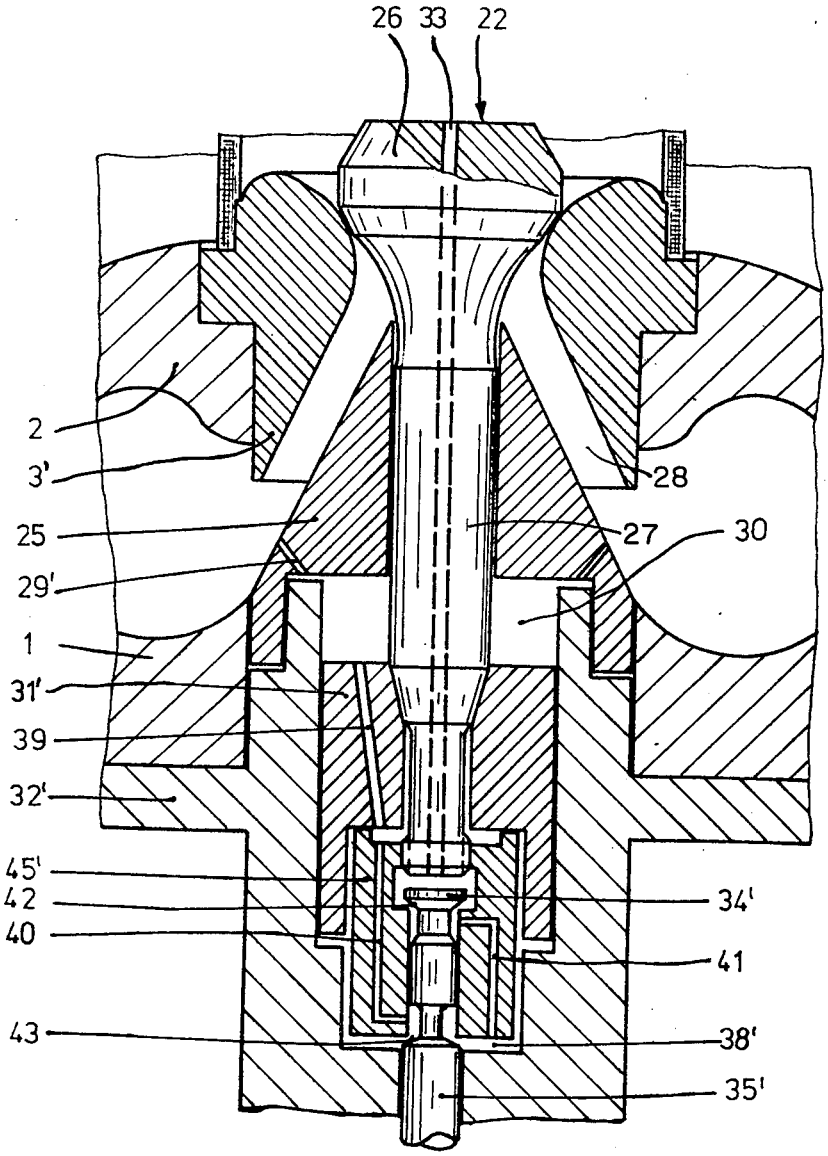

Preferred embodiments of the invention will now be described in detail and are illustrated respectively in the drawings wherein:

FIG. 1 is a view in central longitudinal section through the combined stop and control valve structure of one embodiment; and FIG. 2 is a similar central sectional view of the control valve portion of the combined valve structure which is a modification of the control valve structure depicted in FIG. 1.

In the two figures of the drawings, identical reference numerals have been used for those components which are common to both. However, parts not considered essential to a disclosure of the invention, such as spindle supports and seals have been omitted in the interest of simplifying the drawings but these have been mentioned in the following description.

With reference now to FIG. 1, the essential part of the combined housing for the stop and control valve bodies is indicated at 1, and the valve seat 3 common to both valve bodies is installed within the separating wall 2. A cylindrical steam filter 4 surrounds the valve seat 3, one end of this filter being fitted onto a peripheral portion of the seat 3 and the opposite end being connected to cover 5 for the stop valve 7. Cover 5 is provided with an axially located passageway 6 to accommodate and guide a spindle 10, the end of the latter terminating in a pilot valve 11 which operates between two axially spaced seats 12 and 13 provided in the stop valve body 8 which has a bell-shaped configuration. The stop valve 7 is relieved of pressure during an opening as well as a closing movement by way of bores 14, 15 and 16 arranged in the bell-shaped body. In order to open the stop valve 7 the space 19 within the bell-shaped body 8 is pressurized by way of bores 14, 15 and in order to close this valve, the space 18 at the upper end of the cylindrical part of cover 5 within which the upper piston end 8' of the stop valve body is guided is pressurized by way of bores 15, 16.

The piston end 8' of the stop valve body is provided with longitudinally extending recesses 17 at its periphery through which the working medium, e.g., steam reaches the pressure-equalizing space 18 through bore 16 when the pilot valve 11 is seated on its lower seat 12, the other valve seat 13 therefore being open, so that pressure relief of the spindle and stop valve body 8, respectively takes place during a stop valve closing operation. During a stop valve opening process, the steam enters the interior space 19 of the bell-shaped stop valve body 8 by way of bores 15 and 14 when the pilot valve 11 is raised to its other position, i.e., when seat 12 is opened so that here again a pressure relieving action takes place.

The stop valve body 8 is provided with a shoulder forming a flat seat 20 which seals the steam chamber within the valve housing from the spindle passageway 6 in cover 5 and which also ensures a firm fit of the stop valve body 8 to the cover 5 during operation.

The control valve 22 has a bulb-shaped head portion provided with a circular seating surface 26 which is arranged to make contact with a corresponding seating surface 23 of the valve seat member 3. The bulb-shaped valve head is carried at the end of a spindle 27 which operates within a central bore provided in a lead-through bushing 25 which has a conical configuration. The conical surface of bushing 25 is spaced from a conically shaped surface portion of the valve seat member 3 to form a conical passageway 28 therebetween which serves as a diffusor, forming an outlet passage for the steam leaving the combined stop and control valve housing.

Within the lead-through bushing 25 are provided longitudinally extending passageways 29 which form a connection between the steam flow outlet passageway 28 and the space in one end of cylinder 30 formed in the other housing cover 32 and within which a piston 31 joined to spindle 27 operates. Spindle 27 is provided with a central bore 33 which provides a communication between the space 19 within the stop valve body 8 and the steam chamber, respectively, and a pilot valve 34 which operates within piston 31. Pilot valve 34 is located at one end of a sub-spindle 35 in the piston 31 to which a mounting part 45 is rigidly connected to facilitate assembly.

When pilot valve 34 is moved to its open position by making contact with spindle 27 and clearing the seat 36, steam at the valve input pressure will reach the space 38 within the opposite end of the cylinder for piston 31 by way of the central bore 33 and a ring-shaped gap 37 thus pressure-relieving piston 31 so that the sub-spindle 37 can more easily lift the control valve 22 by exertion of only a slight force.

It will be expedient to dimension the diameter of piston 31 such that pressure-equalization of the cylinder spaces 19 and 38 notwithstanding, there will remain a resultant force component which loads the control valve in a closing direction. In order to control the closing speed of the control valve 22, the operating clearance between piston 31 and its cylinder formed in the cover member 32 provides for a certain amount of leakage as a safety measure. The quantity of steam leaked through this clearance gap reaches the steam flow outlet 28 through the longitudinal passageways 29.

In the modified embodiment for the control valve portion of the combined stop and control valve structure as shown in FIG. 2, pressure relief is provided not only for the spindle of the control valve but also there is effected a continuous follow-up movement of piston 31'. Those components of this embodiment which are identical with those in FIG. 1 have the same reference numerals, and those which have been modified have been designated by addition of a (').  Piston 31' is provided with a bore 39 which operates in conjunction with a bore 40 in the assembly part 45'. The pilot valve 34' is provided with two seats 42, 43 which connect the space 38' in the lower end of the cylinder for piston 31' either with the central bore 33 or with the opposite cylinder space 30. For this purpose there is also provided a compensating bore 41 in the assembly part 45'.

Upon actuation of the sub-spindle 35' in the opening direction of pilot valve 34' valve seat 43 is closed. The pressure within the cylinder space 38' will increase until the forces acting upon piston 31' overcomes the steam force which has retained the control valve head 26 in a closed position. When this state has been reached, the control valve 22 can be opened by means of the sub-spindle 35', and a continuing pressure equalization will also occur between the spaces 19 and 38'.

When the control valve 22 is closed, first the valve seat 42 will be closed and valve seat 43 will open so that a communication will be established between the equalizing space 38' and the steam outlet 28 on the downflow side by way of the passageway 40, bore 39 and the passageways 29'. This will result in a lowering of the presuure level so that upon any further relief of sub-spindle 35', the piston 31' is moved into a closing position by the resultant steam force acting upon the control valve head 26.

The functions served by the stop and control valves are believed to be clear from the description. Assuming that the stop valve 7 is in its open position as shown in FIG. 1, i.e., the position in which the seat 21 on the bell-shaped body 8 is raised off the seat 21', the flow medium, such as steam, enters the steam chamber within the common housing 1 for the stop and control valves through an inlet in the direction indicated by the arrow and passes through the gap formed between seats 21, 21' and thence downardly through a gap formed between the seat 26 on the bulb-shaped head portion of the control valve 22 and seat 23 which regulates steam flow through the valve in accordance with its pilot valve action, the steam being passed to the outlet side of the valve housing by way of the passageway 28 and thence outwardly from the housing in the direction indicated by the arrow.

When the stop valve 7 is actuated to its closed position by pilot valve action, it descends from the position shown in FIG. 1, the head portion of the control valve being entered into the end of the cavity 19 in the stop valve 8 and seat 21 thereon engages the seat 21' thus closing off all steam flow through the valve.

I claim:

1. A combined stop and control valve for the working medium in turbine installations and in particular for steam turbine installations, wherein the bodies of the stop and control valves are arranged co-axially to one another in a common housing and are independently controllable respectively by means of associated pilot valves for controlling flow of the working medium from a valve chamber out of the valve housing, wherein the body of said stop valve has a bell-shaped configuration terminating in a seating surface for closing off flow of the working medium through the valve, and a servo-piston component controlled by its pilot valve and actuated by the working medium, and wherein the body of said control valve has a bulb-shaped head provided with a seating surface for regulating flow of the working medium through the valve, and which is enterable into said bell-shaped stop valve body, said head being located at one end of a spindle slidable in a lead-through bushing, and the other end of said spindle terminating in a servo-piston operating in a cylinder, said spindle including a longitudinal bore therethrough for flow of the working medium from said valve chamber into one end of said servo-piston cylinder when the pilot valve for said contol valve is actuated, said bushing being provided with a passageway placing the other end of said servo-piston cylinder in communication with the outlet side of said valve, the improvement wherein said pilot valve correlated to operation of said control valve body comprises a subsidiary spindle provided with two longitudinally displaced seating surfaces thereon cooperable with corresponding seating surfaces located on an assembly part mounted for movement together with said spindle of said control valve and servo-piston, said assembly part being provided with one bore extending from a location in said pilot valve adjacent one seating surface on said assembly part through a bore in said servo-piston to that end of said servo-piston cylinder which is connected by way of said passageway in said bushing with the outlet side of said valve, and said assembly part being provided also with a second bore extending from the opposite end of said servo-piston cylinder to a location in said pilot valve adjacent the other seating surface on said assembly part for connection with the bore in said control valve spindle.

* * * * *